US010414198B2

(12) United States Patent
Matsushita

(10) Patent No.: US 10,414,198 B2
(45) Date of Patent: Sep. 17, 2019

(54) DOUBLE CLIP

(71) Applicant: PLUS CORPORATION, Tokyo (JP)

(72) Inventor: Togo Matsushita, Tokyo (JP)

(73) Assignee: Plus Corporation, Tokyo (JP)

( * ) Notice: Subject to any disclaimer, the term of this patent is extended or adjusted under 35 U.S.C. 154(b) by 0 days.

(21) Appl. No.: 16/031,739

(22) Filed: Jul. 10, 2018

(65) Prior Publication Data

US 2019/0016172 A1 Jan. 17, 2019

(30) Foreign Application Priority Data

Jul. 11, 2017 (JP) ..... 2017-135554
Mar. 2, 2018 (JP) ..... 2018-037031

(51) Int. Cl.
*B42F 1/06* (2006.01)
*B42F 1/00* (2006.01)
*B42F 1/02* (2006.01)

(52) U.S. Cl.
CPC ..... *B42F 1/006* (2013.01); *B42F 1/02* (2013.01); *Y10T 24/204* (2015.01)

(58) Field of Classification Search
CPC ..... B42F 1/006; B42F 1/06; Y10T 24/204; Y10T 24/203
See application file for complete search history.

(56) References Cited

U.S. PATENT DOCUMENTS 5,806,147 A * 9/1998 Sato ..... B42F 1/04 24/545
5,896,624 A 4/1999 Horswell
5,950,283 A 9/1999 Sato
7,120,970 B2 * 10/2006 Thomson ..... A45C 1/06 24/67.5
2015/0342313 A1 12/2015 Antinone

FOREIGN PATENT DOCUMENTS

JP 3117841 U 12/2005

OTHER PUBLICATIONS

Extended European Search Report from the Munich Patent Office in Application No. 18177483.7-1014 dated Oct. 22, 2018.

* cited by examiner

*Primary Examiner* — Abigail E Troy
(74) *Attorney, Agent, or Firm* — The Marbury Law Group, PLLC

(57) ABSTRACT

To provide a double clip that can reduce a force for an opening operation while maintaining a length of lever members as long as conventional ones, a double clip 1 includes a clip main body 10 and a pair of lever members 30. The clip main body has two plate-shaped portions 11, 12 and a bottom plate portion 13 connecting thereto. An opening portion 14 is formed by the plate-shaped portions abutting with each other by virtue of elasticity thereof. The lever members are formed long and connect to the plate-shaped portions. First fulcrum portions 11*a*, 12*a* are formed between the plate-shaped portions and the lever members to constitute fulcrums of the lever members when they perform an opening operation. The first fulcrum portions are disposed closer to a bottom plate portion side than a central position of a distance from the bottom plate portion to the opening portion.

3 Claims, 17 Drawing Sheets

DOUBLE CLIP

CROSS-REFERENCE TO RELATED APPLICATION

This patent application is based upon and claims the benefit of priority under 35 USC 119 of Japanese Patent Applications No. 2017-135554 filed on Jul. 11, 2017 and No. 2018-037031 filed on Mar. 2, 2018, the entire disclosure of which, including the description, claims, drawings and abstract, is incorporated herein by reference.

BACKGROUND OF THE INVENTION

Field of the Invention

The present invention relates to a double clip.

Description of the Related Art

Conventionally, there have been disclosed double clips for holding documents in which a force required to open an opening portion is reduced. For example, Japanese Utility Model Registration No. 3117841 (Patent Document 1) discloses a double clip includes a clip main body and a pair of handle or lever members for opening the clip main body. The clip main body is formed by bending a metallic plate material into a body having a substantially triangular shape when seen from a side thereof and includes an opening portion that is kept closed by virtue of the spring or elasticity of the metallic plate material. The lever members are connected rotatably to the clip main body at pivotally shaft supporting portions formed at the opening portion. Then, fulcrum portions are formed on the clip main body in positions located adjacent to the pivotally shaft supporting portions so as to project from the clip main body. When opening the double clip, the lever members are brought into abutment with the corresponding fulcrum portions, and the lever members are operated to be pivoted on these abutment points as fulcrums, whereby the opening portion of the clip main body is opened.

According to the double clip disclosed in Japanese Utility Model Registration No. 3117841 (Patent Document 1), by forming the fulcrums where the lever members for opening the clip main body and the clip main body are brought into abutment with each other in the positions situated adjacent to the opening portion (the shaft pivotally supporting portions), a distance between the point of application and the fulcrum becomes short (in other words, the distance from the fulcrum to an end portion of the lever member becomes long), and therefore, the force is reduced that is required to open the double clip. However, in the double clip disclosed in Japanese Utility Model No. 3117841, the force with which the lever members press against the corresponding fulcrum works in a direction in which the opening portion is closed, and the force is greater than a force with which the opening portion is opened by the lever members. Consequently, in the double clip disclosed in Patent Document 1, the force required to open the opening portion is increased. In this case, to attempt to reduce the force required to open the opening portion, the lever members themselves need to be formed longer, resulting in a case where the double clip itself is enlarged in size.

SUMMARY OF THE INVENTION

The invention has been made in view of these situations, and an object thereof is to provide a double clip whose levers remain the same in length as those of the conventional double clips while reducing a force required in execution of an opening operation.

According to an aspect of the invention, there is provided a double clip including a clip main body having two plate-shaped portions and a bottom plate portion that connects to the plate-shaped portions and in which an opening portion is formed by the plate-shaped portions being brought into abutment with each other by virtue of spring or elasticity thereof, a pair of lever members formed into an elongated shape and connected individually to the plate-shaped portions, and fulcrum portions formed individually between the plate-shaped portions and the lever members to function as fulcrums when the pair of lever members perform an opening operation to open the opening portion, wherein the fulcrum portions are formed closer to the bottom plate portion than a central position along a distance defined from the bottom plate portion to the opening portion.

According to the aspect of the invention, it is possible to provide the double clip whose levers remain the same in length as those of the conventional double clips while reducing the force required in execution of the opening operation.

DETAILED DESCRIPTION OF THE PREFERRED EMBODIMENT

Figure 1:
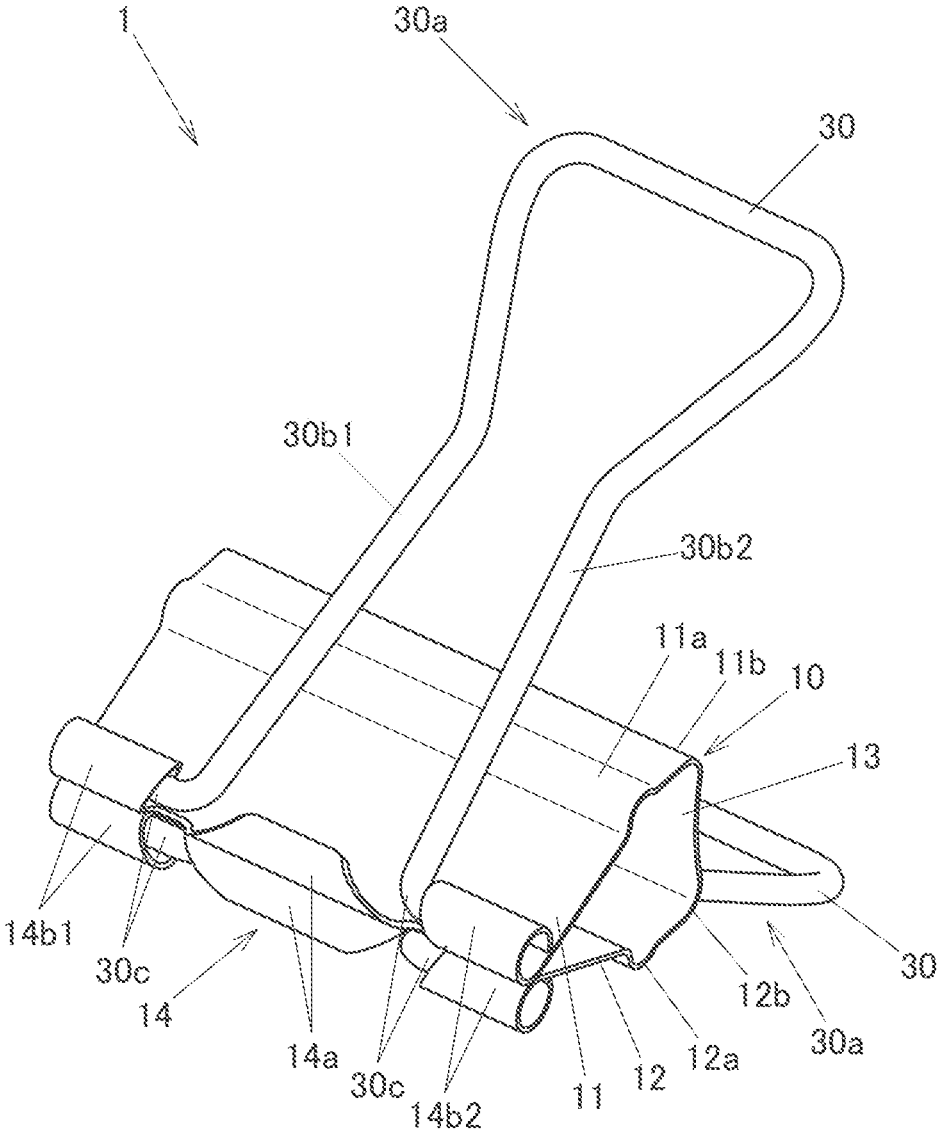
FIG. 1 is a perspective view of a double clip according to an embodiment of the invention as seen from an opening portion side thereof.
Figure 2:
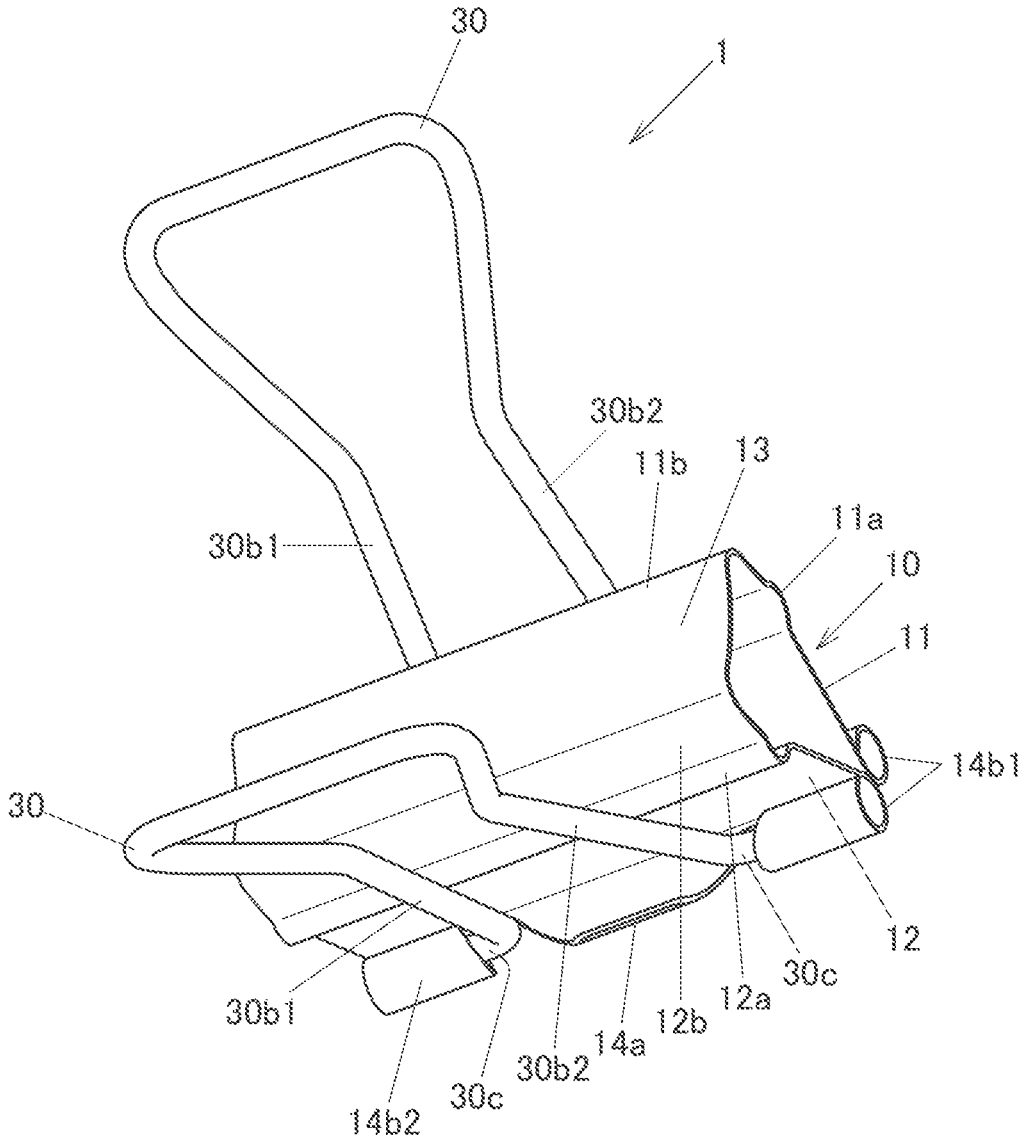
FIG. 2 is a perspective view of the double clip according to the embodiment of the invention as seen from a bottom plate portion side thereof.

Next, an embodiment of the invention will be described based on the drawings. As shown in FIGS. 1 and 2, a double clip 1 includes a clip main body 10 and a pair of handle or lever members 30. The clip main body 10 is formed by bending a metallic plate. The clip main body 10 includes two plate-shaped portions 11, 12 that are disposed to face each other and a bottom plate portion 13 to which the plate-shaped portions 11, 12 connect. End portions of the plate-shaped portions 11, 12 are brought into abutment with each other by virtue of spring or elasticity of the metallic plate to thereby constitute a holding portion or an opening portion 14 that is opened through an opening operation using the lever members 30. Connecting portions where the plate-shaped portions 11, 12 connect to the bottom plate portion 13 are each worked into a round portion. The plate-shaped portions 11, 12 connect to the bottom plate portion 13 substantially at right angles at these connecting portions. In other words, the plate-shaped portions 11, 12 become substantially parallel to each other at the connecting portions. Consequently, even when documents or the like are held by the double clip 1, the plate-shaped portions 11, 12 protrude little from surfaces of the held documents or the like (surfaces of pieces of paper) (that is, inner surfaces of the plate-shaped portions 11, 12 are in contact with or lie close to the surfaces of the held documents or the like), thereby making it possible to improve the design properties of the double clip 1 when it holds documents or the like. Although this will be described later, the connecting portions are configured as second fulcrum portions 11*b*, 12*b*.

Central bent portions 14*a* are formed at centers of the end portions (that is, the opening portion 14 side end portions) of the plate-shaped portions 11, 12. The central bent portions 14*a* are bent outwards so that distal end portions are formed into an outwardly protuberant curved surface. Pivotally shaft supporting portions 14*b*1, 14*b*2, each having a substantially cylindrical shape, are formed at both sides in a width direction of the central bent portion 14*a* of each of the end portions of the plate-shaped portions 11, 12. A shape resulting when a cylinder is cut obliquely is given to sides of the pivotally shaft supporting portions 14*b*1, 14*b*2 that face the central bent portion 14*a* in such a manner that a distal end side of the resulting obliquely cut plane is positioned outwards. By adopting this configuration, a user can feel a sensation of resistance when pivoting or rotating the lever members 30, which will be described later, whereby the use is prevented from shifting inadvertently the levers 30 from a state where the levers 30 are closed together (refer to FIG. 3) to a state where the levers 30 are ready for an opening operation (refer to FIGS. 1, 2) or from the state where the levers 30 are ready for an opening operation to the state where the levers 30 are closed together.

First fulcrum portions 11*a*, 12*a* are formed on the plate-shaped portions 11, 12, respectively. These first fulcrum portions 11*a*, 12*a* constitute fulcrums when the levers 30 are operated to open the opening portion 14. The first fulcrum portions 11*a*, 12*a* are formed to extend along a full width of the plate-shaped portions 11, 12 so as to protrude from flat outer surfaces of the plate-shaped portions 11, 12. The first fulcrum portions 11, 12 each have a protruding arc shape when seen from a side thereof. Namely, the first fulcrum portions 11*a*, 12*a* reformed between the plate-shaped portions 11, 12 and the lever members 30.

Figure 4A:
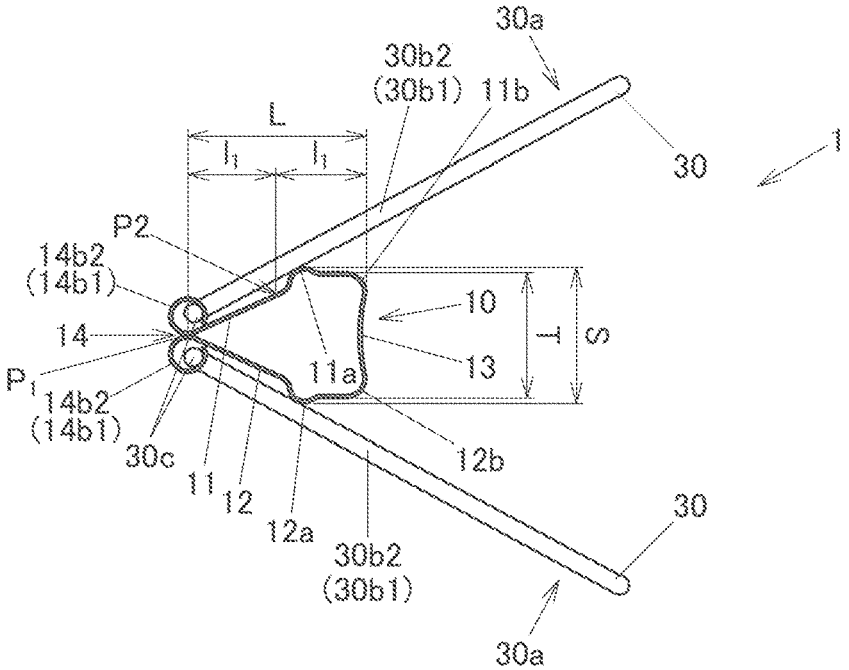
FIG. 4A is a side view of the double clip according to the embodiment of the invention showing a closed state in an opening operation.

Then, as shown in FIG. 4A, the first fulcrum portions 11*a*, 12*a* are disposed closer to a bottom plate portion 13 side than a central position P2 (in FIG. 4A, 11=½L) of a distance L from the bottom plate portion 13 to the opening portion 14 (specifically, a point P1 where the plate-shaped portions 11, 12 are brought into abutment with each other by virtue of spring or elasticity of the metallic plate). Then, an inter-fulcrum portion distance S between the first fulcrum portions 11*a*, 12*a* is greater than a dimension (a height dimension T) of the bottom plate portion 13 in the same direction as the direction of the inter-fulcrum portion distance S. Additionally, the plate-shaped portions 11, 12 are formed to be inclined from the first fulcrum portions 11*a*, 12*a* to the opening portion 14 so that the end portions of the plate-shaped portions 11, 12 at the opening portion 14 are brought into abutment with each other. In this way, the plate-shaped portions 11, 12 have a sufficient length from the first fulcrum portions 11*a*, 12*a* to the opening portion 14, and the end portions of the plate-shaped portions 11, 12 are brought into abutment with each other by virtue of an elastic or spring-back force of the metallic plate. In other words, the opening portion 14 is biased in a closing direction by virtue of the spring-back force of the metal plate.

Figure 3:
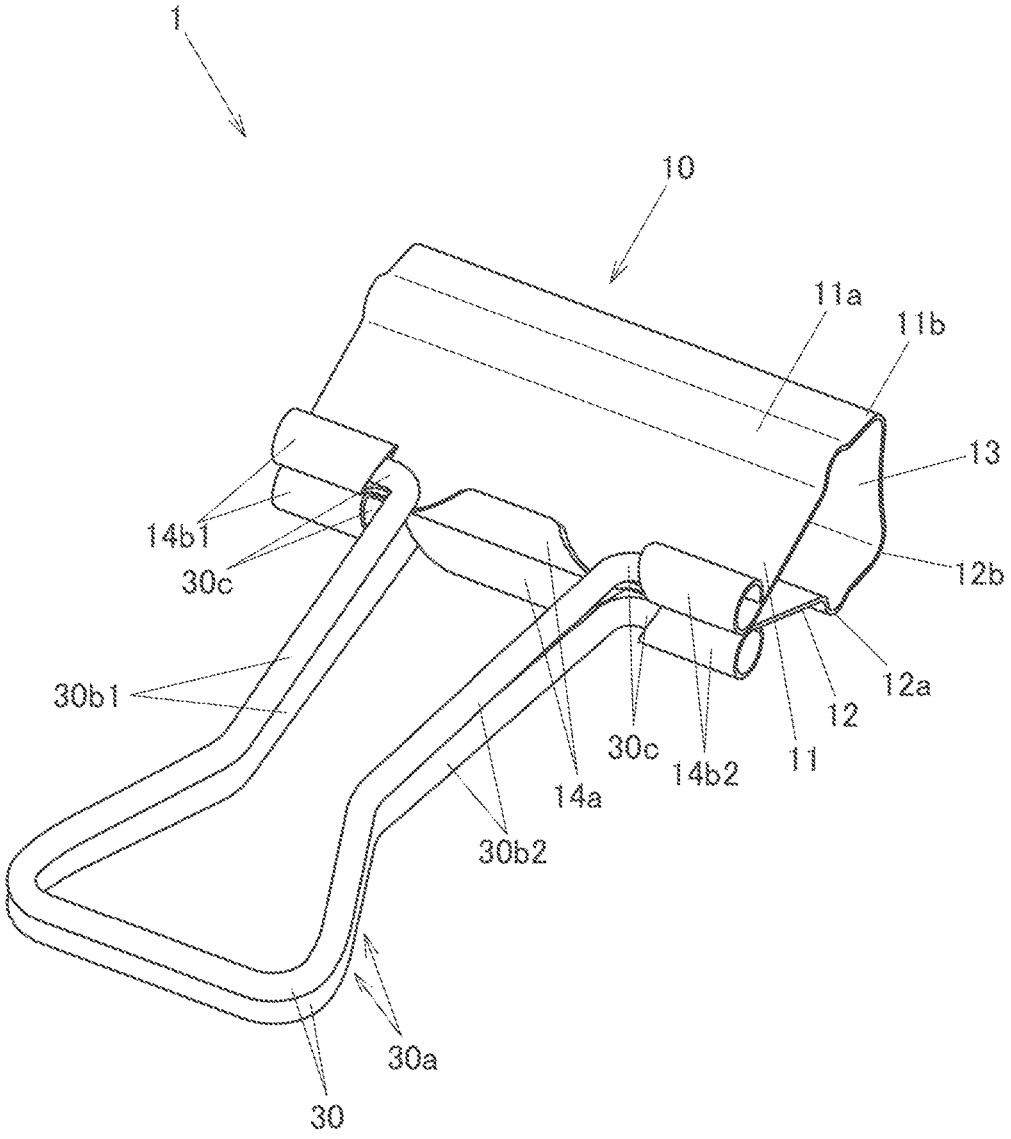
FIG. 3 is a perspective view of the double clip according to the embodiment of the invention with a pair of lever members closed together.

Returning to FIGS. 1 and 2, the pair of lever members 30 of the double clip 1 are formed long and are connected to the plate-shaped portions 11, 12 pivotally or rotatably. Specifically speaking, the lever members 30 are formed by bending a metallic wire material. A substantially triangular gripping portion 30*a* is formed by bending the metallic wire material twice among several bends made therein. Linear wire portions 30*b*1, 30*b*2 formed by bending the wire material twice extend towards an opening portion 14 side and are then bent outwards at end portions, whereby the end portions are formed into rotational shafts 30*c*. The rotational shaft portions 30C are then inserted into the pivotally shaft supporting portions 14*b*1, 14*b*2 while being biased outwards by the two linear wire portions 30*b*1, 30*b*2 that are so biased by virtue of spring or elasticity of the wire material. In this way, the lever members 30 are connected rotatably to the plate-shaped portions 11, 12. Then, the pair of lever members 30 are rotated towards the opening portion 14 side from the state where the lever members 30 are ready to open the opening portion 14 as shown in FIGS. 1 and 2 to the state where the lever members 30 are closed together or are brought into abutment with each other as shown in FIG. 3.

Next, referring to FIGS. 4A to 4C, an opening operation of opening the opening portion 14 will be described that is performed when documents or the like are held by the double clip 1.

Similar to FIGS. 1 and 2, FIG. 4A shows a closed state of the opening portion 14. An opening operation of the opening portion 14 is performed from this. In other words, the pair of lever members 30 are operated in a direction in which the gripping portions 30*a* are brought together. As this occurs, the linear wire portions 30*b*1, 30*b*2 of the pair of lever members 30 are brought into abutment with the first fulcrum portions 11*a*, 12*a* that constitutes the fulcrums, and the first fulcrum portions 11*a*, 12*a* (specifically, abutment points between the lever members 30 and the first fulcrum portions 11*a*, 12*a*) function as fulcrums of the pair of lever members 30 when the opening operation is performed.

Figure 4B:
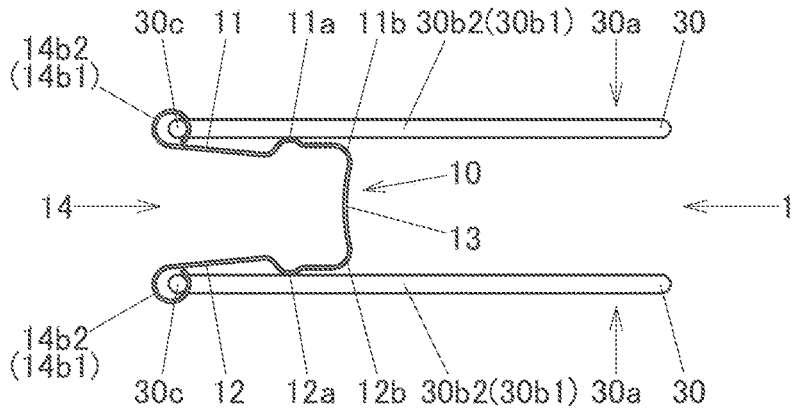
FIG. 4B is a side view of the double clip according to the embodiment of the invention showing a middle state in the opening operation.
Figure 4C:
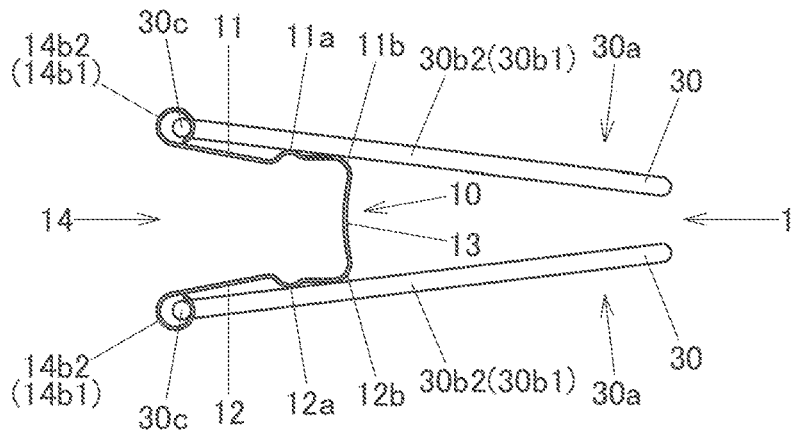
FIG. 4C is a side view of the double clip according to the embodiment of the invention showing a state in the opening operation where fulcrums are shifted.

Then, as shown in FIG. 4B, the first fulcrum portions 11*a*, 12*a* continue to remain as the fulcrums of the pair of lever members 30 at least until the pair of lever members 30 become parallel to each other (in other words, until the opening portion 14 opens to define a predetermined open space therein) in the opening operation. Then, as shown in FIG. 4C, when the opening operation of the opening portion 14 continues further from the state where the pair of lever members 30 have become parallel to each other (in other words, the state where the opening portion 14 has opened to define the predetermined open space therein), the fulcrums of the pair of lever members 30 shift to the second fulcrum portions 11*b*, 12*b* (similarly, specifically speaking, abutment points between the lever members 30 and the second fulcrum portions 11*b*, 12*b*).

In this way, the first fulcrum portions 11*a*, 12*a* that constitute the fulcrums of the lever members 30 in the opening operation are positioned closer to the opening portion 14 side than the connecting portions between the bottom plate portion 13 and the plate-shaped portions 11, 12 (the second fulcrum portions 11*b*, 12*b* that are formed closer to the bottom plate portion 13 side than the first fulcrum portions 11*a*, 12*a* in the positions facing the pair of lever members 30). By adopting this configuration, a distance from the gripping portion 30*a* that functions as a point of force of each of the pair of lever members 30 to the fulcrum portion (the first fulcrum portion 11*a* or 12*a*) thereof becomes longer than a conventional distance (that is, a distance corresponding to a distance from the gripping portion 30*a* to the second fulcrum portion 11*b* or 12*b*), while a distance from the fulcrum point portion (the first fulcrum portion 11*a* or 12*a*) to a point of application (that is, the position of the rotational shaft 30*c* that is inserted into the pivotally shaft supporting portion 14*b*1 or 14*b*2) becomes short, whereby a force required for the opening operation is reduced. Moreover, the fulcrum portions (the first fulcrum portions 11*a*, 12*a*) are disposed closer to the bottom plate portion 13 side than the central position P2 of the distance L from the bottom plate portion 13 to the opening portion 14, and this makes a pressing force that is exerted on the fulcrum portions (the first fulcrum portions 11*a*, 12*a*) by the lever members 30 to close the opening portion 14 greater than a force with which the lever members 30 separate upwards and downwards the end portions of the plate-shaped portions 11, 12 to open the opening portion 14, whereby the force required for the opening operation can be reduced in an ensured fashion.

Further, in the opening operation of the opening portion 14, when the opening operation of the opening portion 14 is continuously performed further from the state where the pair of lever members 30 have become parallel to each other as shown in FIG. 4B, the fulcrums of the lever members 30 shift from the first fulcrum portions 11*a*, 12*a* to the second fulcrum portions 11*b*, 12*b*. Here, the second fulcrum portions 11*b*, 12*b* are disposed closer to a gripping portion 30*a* side than the first fulcrum portions 11*a*, 12*a*. Consequently, when the fulcrums shift from the first fulcrum portions 11*a*, 12*a* to the second fulcrum portions 11*b*, 12*b*, since a distance from the griping portion 30*a* of the lever member 30 to the fulcrum becomes short, the force required for the opening operation is increased. Then, the user can detect that the opening portion 14 is opened too much, whereby an unsafe operation of the user such as an insertion of his or her finger into the clip main body 10 from the opening portion 14 can be reduced that would otherwise be caused as a result of the opening portion 14 being opened too much.

First Modified Example

Figure 5A:
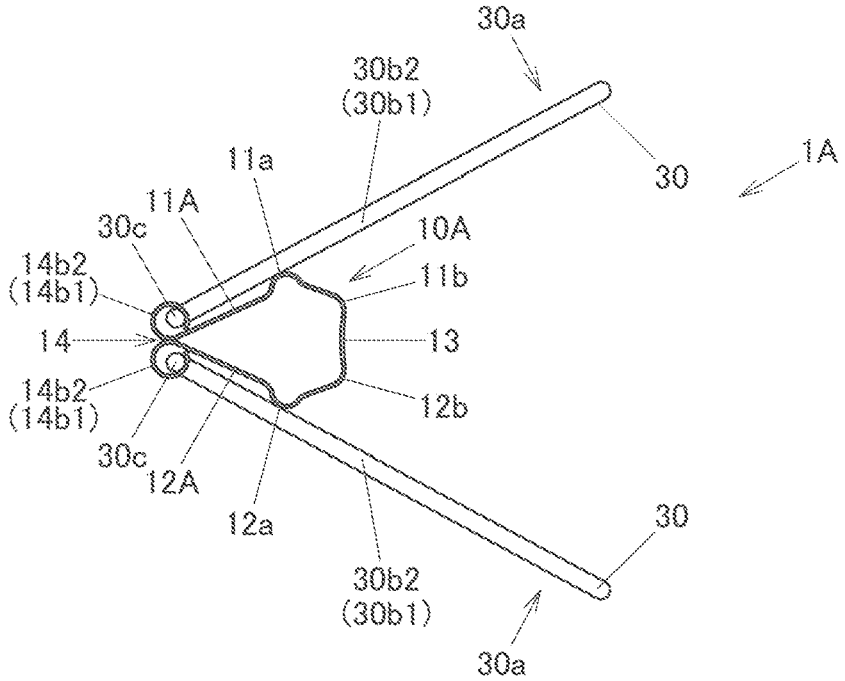
FIG. 5A is a side view of a double clip according to a first modified example made to the embodiment of the invention showing a closed state in an opening operation.
Figure 5B:
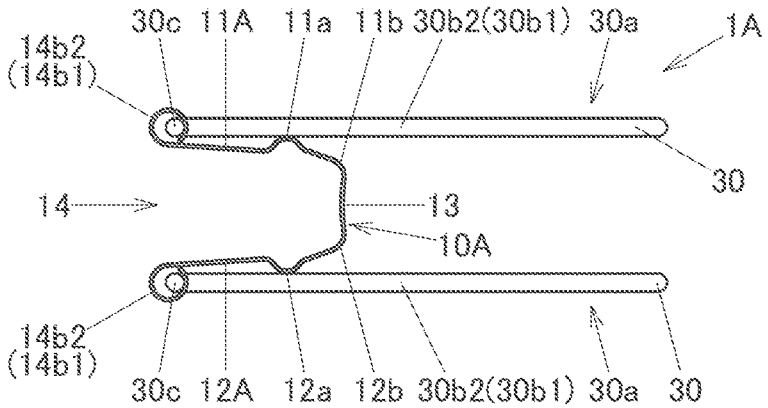
FIG. 5B is a side view of the double clip according to the first modified example made to the embodiment of the invention showing a middle state in the opening operation.

Next, referring to FIGS. 5A to 5C, a double clip 1A according to a first modified example made to the embodiment of the invention will be described. Here, like reference numerals will be given to like members and portions to those of the double clip 1 described in the embodiment, and a description thereof will be omitted or simplified. In the clip main body 10 of the embodiment described above, the plate-shaped portions 11, 12 are formed substantially parallel to each other from the connecting portions between the bottom plate portion 13 and the plate-shaped portions 11, 12 to the first fulcrum portions 11*a*, 12*a*. In the double clip 1A of the first modified example, however, plate-shaped portions 11A, 12A are inclined so as to move away from each other or expand outwards towards an opening portion 14 when the clip main body 10A is seen from a side thereof. In other words, internal angles of the connecting portions where the bottom plate portion 13 connects to the plate-shaped portions 11, 12 are a right angle, while in the first modified example, internal angles of connecting portions where a bottom plate portion 13 connects the plate-shaped portions 11A, 12A are an obtuse angle.

Figure 5C:
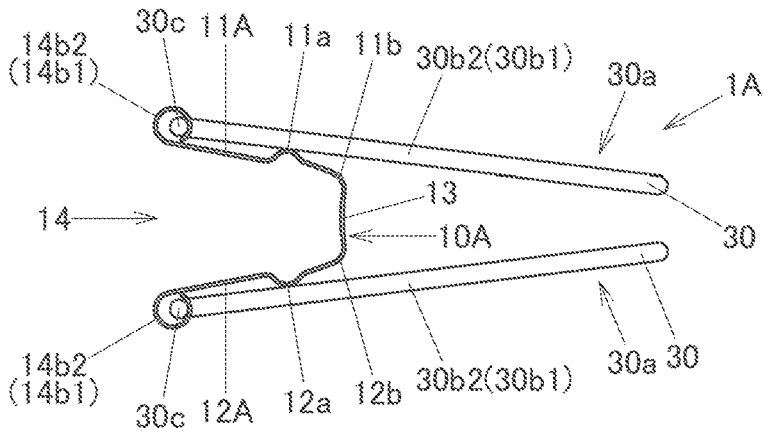
FIG. 5C is a side view of the double clip according to the first modified example made to the embodiment of the invention showing a state in the opening operation where a clip main body is opened further.

Adopting this configuration allows the opening portion 14 to open greatly as shown particularly in FIG. 5C. This facilitates an insertion of documents to be held from the opening portion 14.

Second Modified Example

Figure 6A:
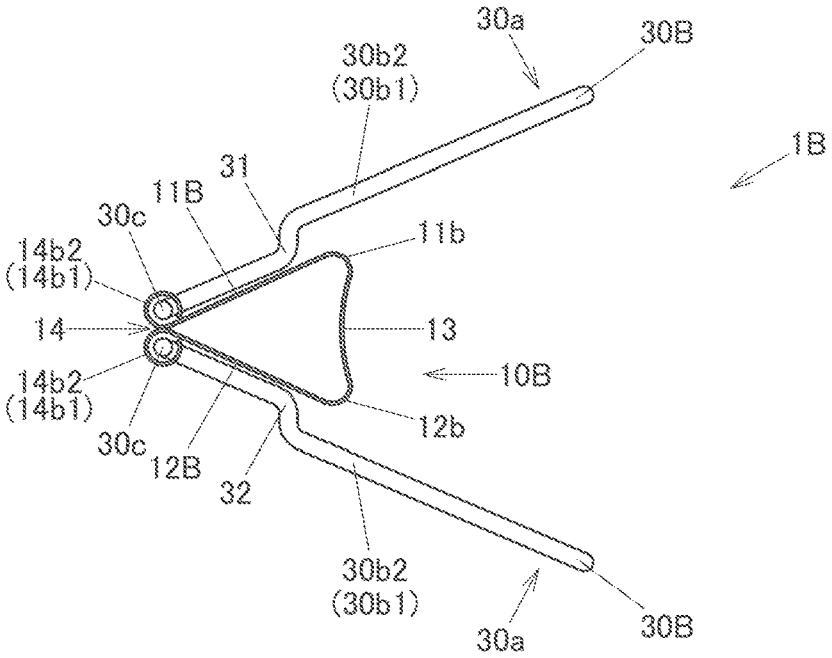
FIG. 6A is a side view of a double clip according to a second modified example made to the embodiment of the invention showing a closed state in an opening operation.
Figure 6B:
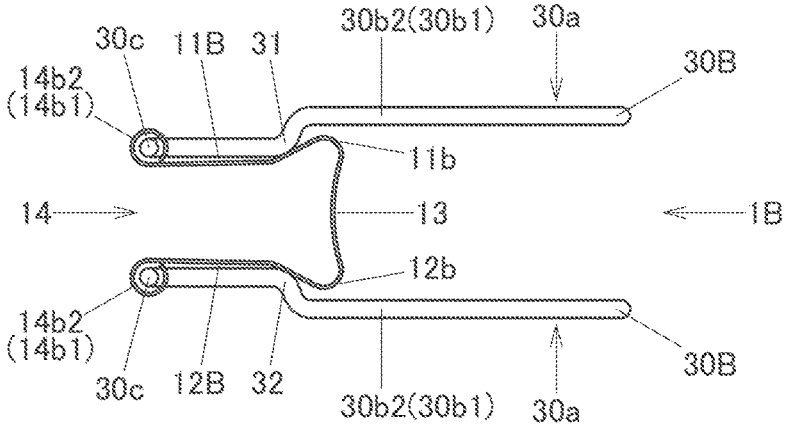
FIG. 6B is a side view of the double clip according to the second modified example made to the embodiment of the invention showing a middle state in the opening operation.
Figure 6C:
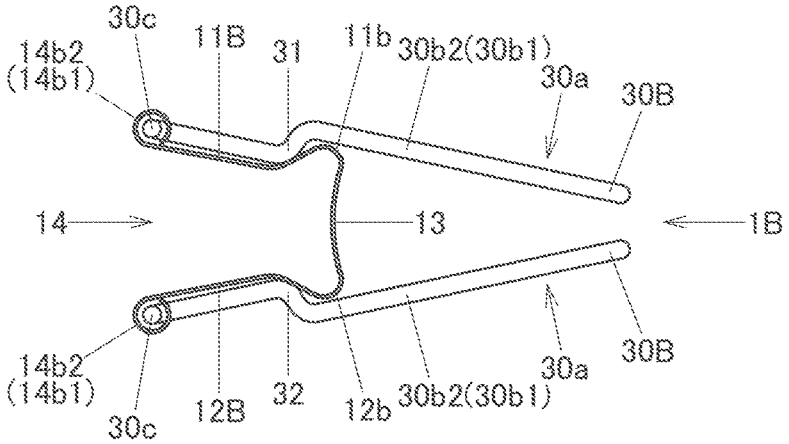
FIG. 6C is a side view of the double clip according to the second modified example made to the embodiment of the invention showing a state in the opening operation where fulcrums are shifted.

Next, referring to FIGS. 6A to 6C, a double clip 1B according to a second modified example made to the embodiment of the invention will be described. Here, like reference numerals will be given to like members and portions to those of the double clip 1 described in the embodiment, and a description thereof will be omitted or simplified. In the double clip 1B, a clip main body 10B has a substantially triangular shape when seen from a side thereof. Consequently, plate-shaped portions 11B, 12B are formed substantially flat. Then, a pair of lever members 30B have formed thereon abutment portions 31, 32 that are bent so as project towards the clip main body 10B. These abutment portions 31, 32 are brought into abutment with the corresponding plate-shaped portions 11B, 12B. Consequently, abutment points between the abutment portions 31, 32 and the plate-shaped portions 11B, 12B constitute fulcrums when the pair of lever members 30B are operated to open an opening portion 14. Namely, the abutment portions 31, 32 that are fulcrum portions constituting fulcrums when the lever members 30 are operated to open the opening portion 14 are formed between the plate-shaped portions 11B, 12B and the lever members 30B. In this way, according to the lever members 30B, it is possible to use the clip main body 10B having a shape similar to the conventional shape.

In this way, according to the double clips 1, 1A, 1B, the length of the lever members 30, 30B is allowed to remain the same as that of the conventional lever members while reducing the force that is required to open the opening portion 14.

Third Modified Example

Figure 7:
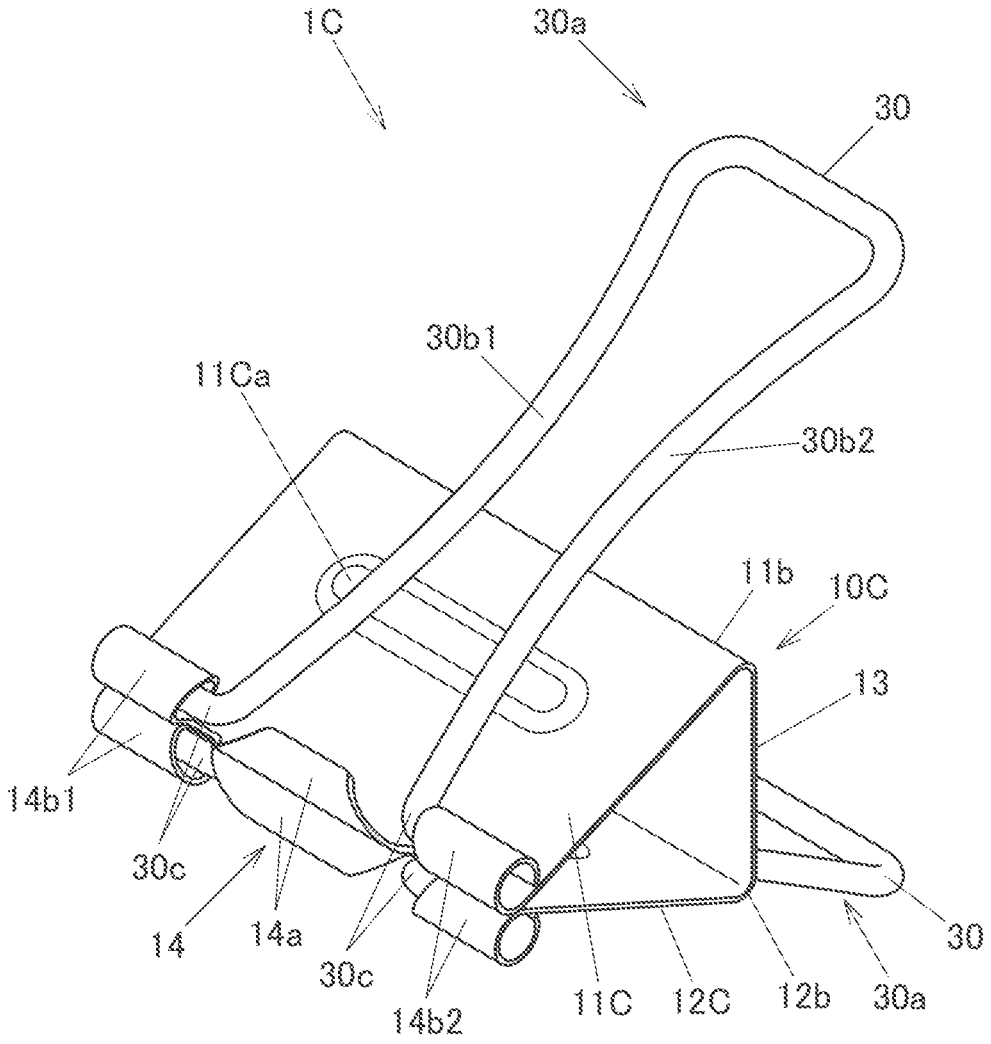
FIG. 7 is a perspective view of a double clip according to a third embodiment made to the embodiment of the invention as seen from an opening portion side thereof.
Figure 8:
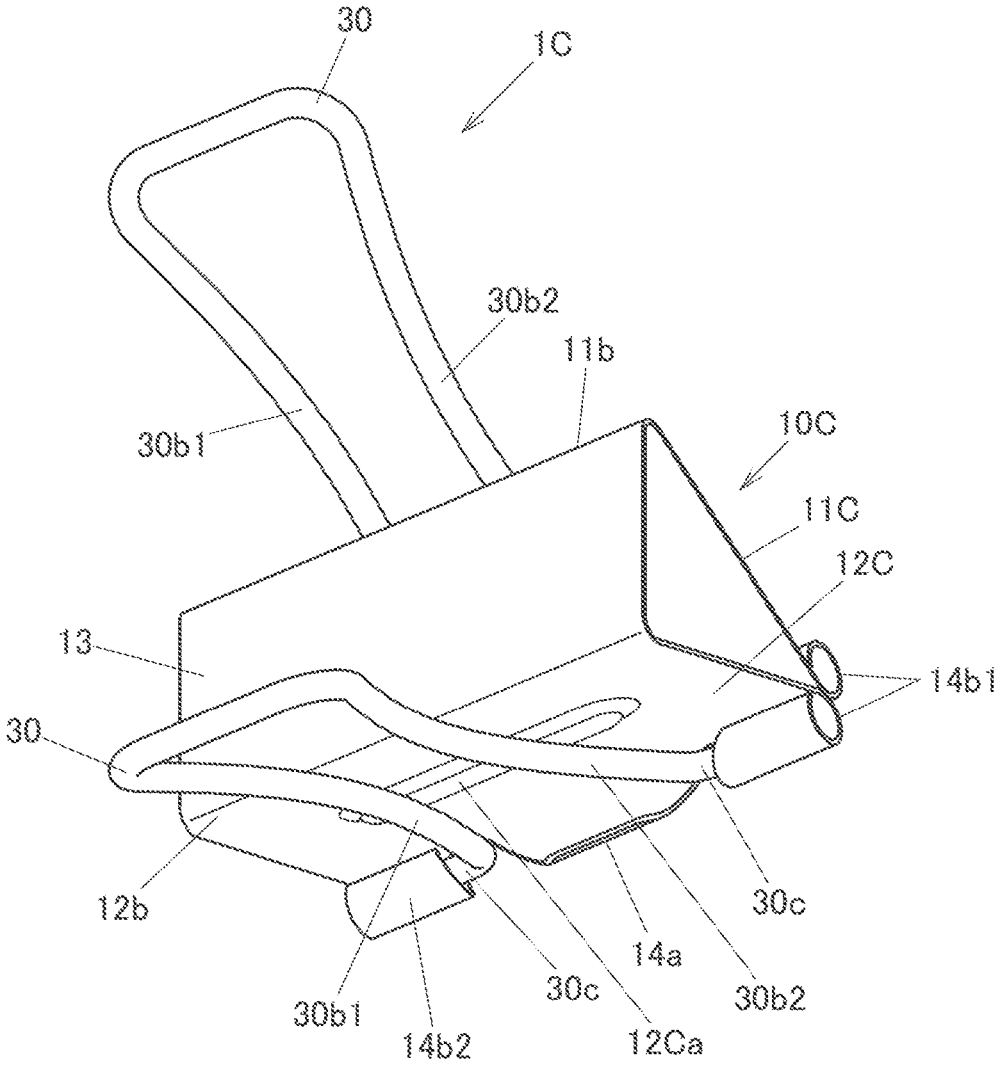
FIG. 8 is a perspective view of the double clip according the third modified example made to the embodiment of the invention as seen from a bottom plate portion side thereof.
Figure 9:
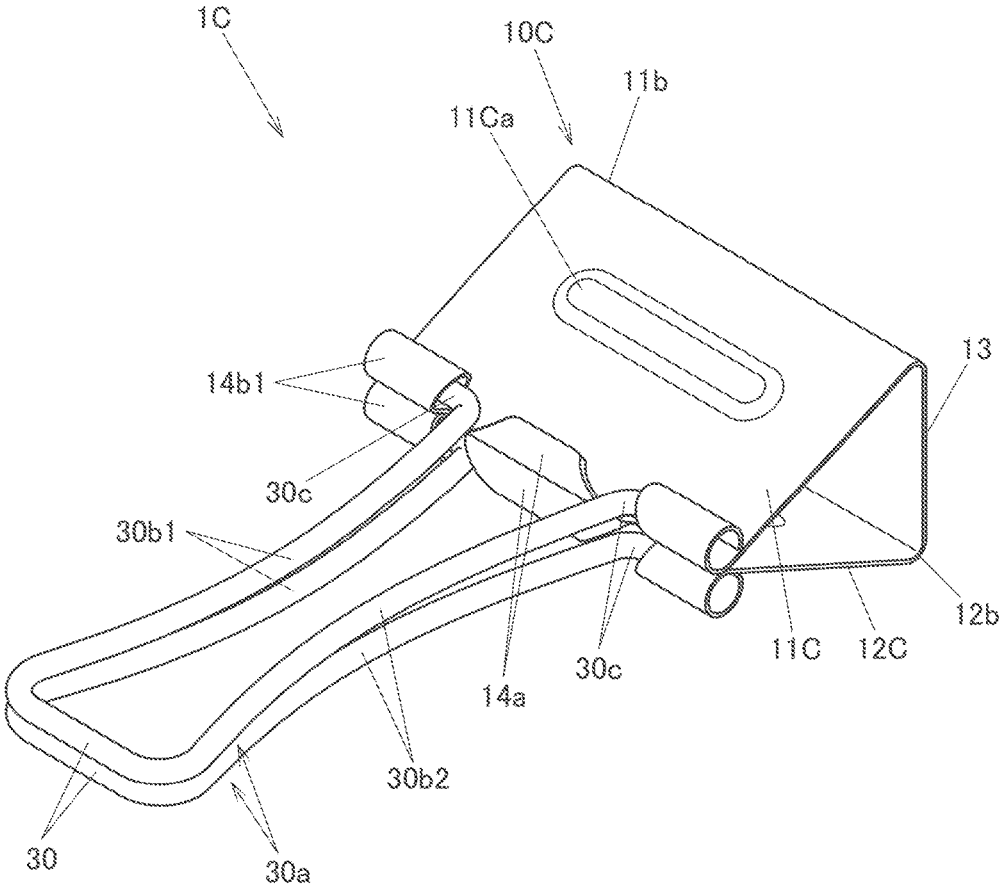
FIG. 9 is a perspective view of the double clip according to the third modified example made to the embodiment of the invention with a pair of lever members closed together.
Figure 10A:
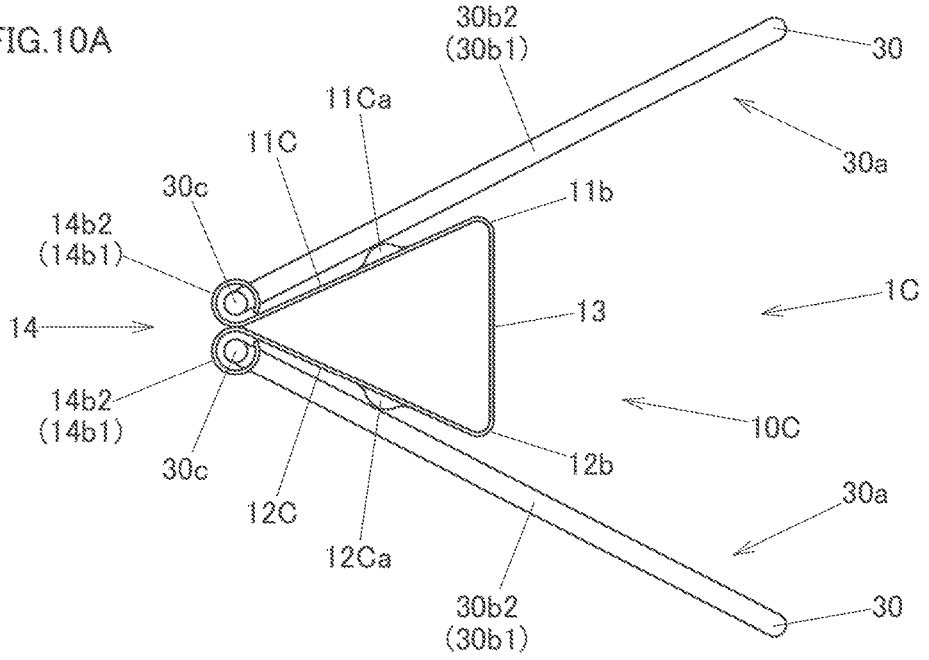
FIG. 10A is a side view of the double clip according to the third modified example made to the embodiment of the invention showing a closed state in an opening operation.
Figure 10B:
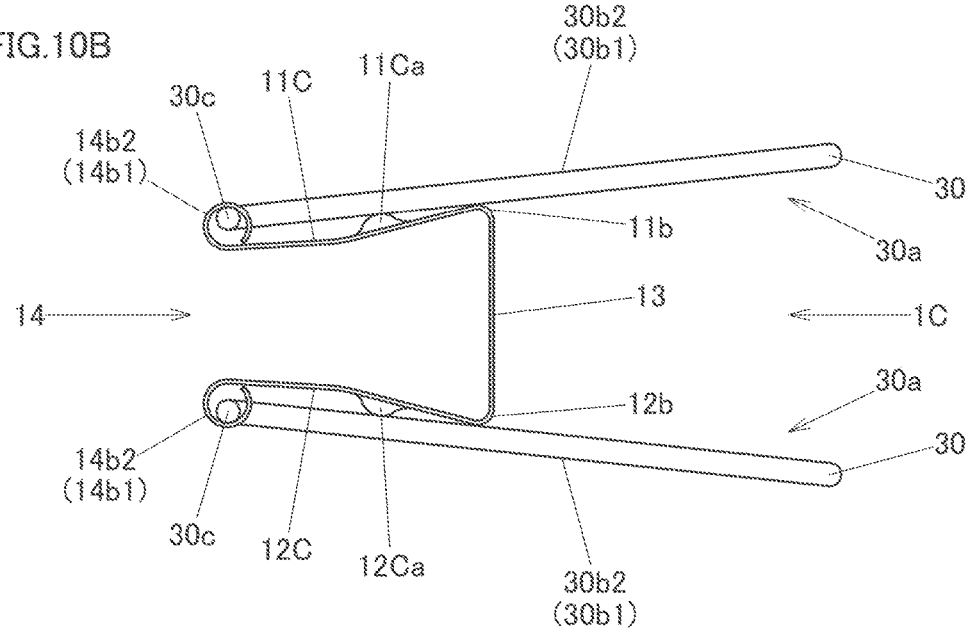
FIG. 10B is a side view of the double clip according to the third modified example made to the embodiment of the invention showing a state in the opening operation where fulcrums are shifted.

Next, referring to FIGS. 7 to 10, a double clip 1C according to a third modified example made to the embodiment of the invention will be described. Here, like reference numerals will be given to like members and portions to those of the double clip 1 described in the embodiment, and a description thereof will be omitted or simplified. In the double clip 1C of the third modified example, in place of the first fulcrum portions 11*a*, 12*a* of the double clip 1 of the embodiment that are formed on the plate-shaped portion 11, 12 so as to extend along the width direction thereof, first fulcrum portions 11Ca, 12Ca are provided on plate-shaped portions 11C, 12C so as to extend a predetermined length that is shorter than a width of the plate-shaped portions 11C, 12C while protruding from outer surfaces thereof. The first fulcrum portions 11Ca, 12Ca are elongated longitudinally in a width direction of the clip main body 10C and have arc-shaped end portions. As shown in FIGS. 10A, 10B, when the clip main body 10*c* is seen from a side thereof, the first fulcrum portions 11Ca, 12Ca have a protuberant arc shape. Similar to the double clip 1 of the embodiment described above, in the double clip 1C of the third modified example, a pair of lever members 30 are operated to open an opening portion 14. The lever members 30 are disposed so that linear wire portions 30*b*1, 30*b*2 are brought into abutment with the first fulcrum portions 11Ca, 12Ca, as shown in FIGS. 7 and 8 when operated so. As shown in FIG. 9, the pair of lever members 30 can also be closed together.

Fulcrums of the lever members 30 that work when the lever members 30 are operated to open the double clip 1C are similar to those of the lever members 30 of the double clip 1 of the embodiment described above. Namely, as shown in FIGS. 10A, 10B, the first fulcrum portions 11Ca, 12Ca remain as the fulcrums of the lever members 30 that are operated to open the opening portion 14 until the opening portion 14 is opened from a closed state (a state shown in FIG. 10A) to a state where a predetermined open space is defined in the opening portion 14 (a state shown in FIG. 10B). When the lever members 30 are operated further to open the opening portion 14 after the predetermined open space is defined in the opening portion 14, the fulcrums of the lever members 30 shift to second fulcrum portions 11*b*, 12*b*.

Fourth Modified Example

Figure 11:
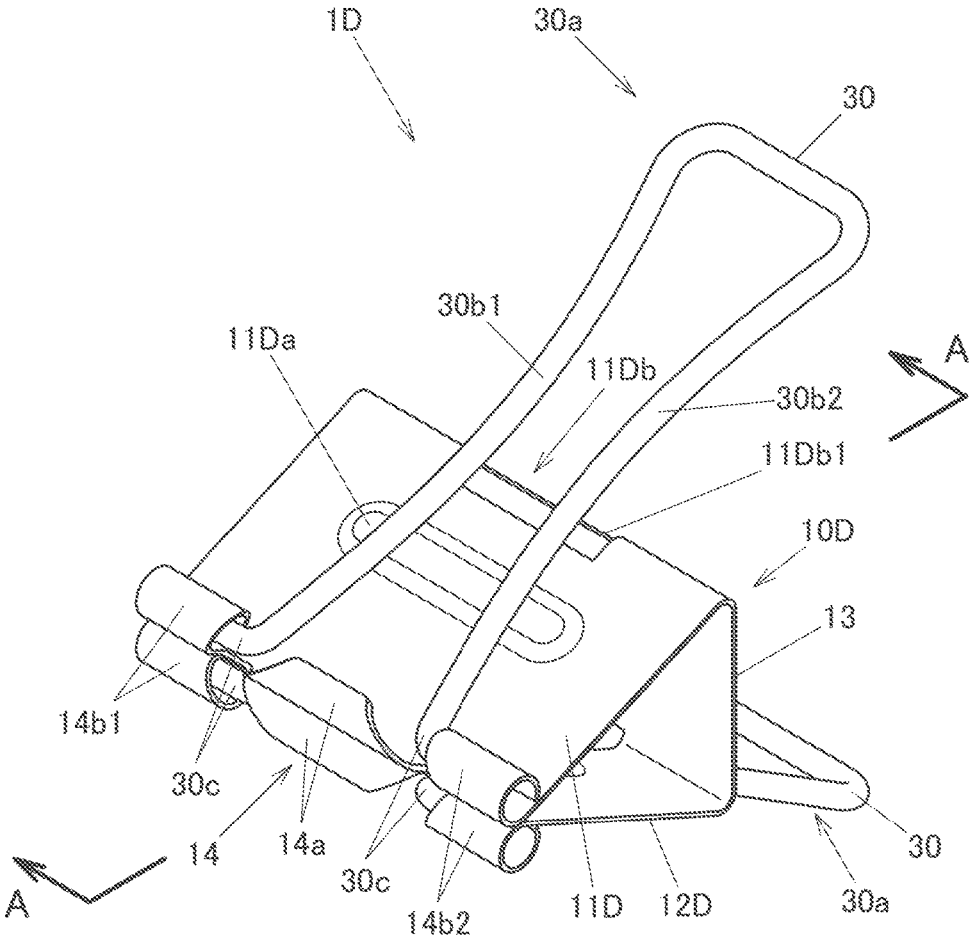
FIG. 11 is a perspective view of a double clip according to a fourth embodiment made to the embodiment of the invention as seen from an opening portion side thereof.
Figure 12:
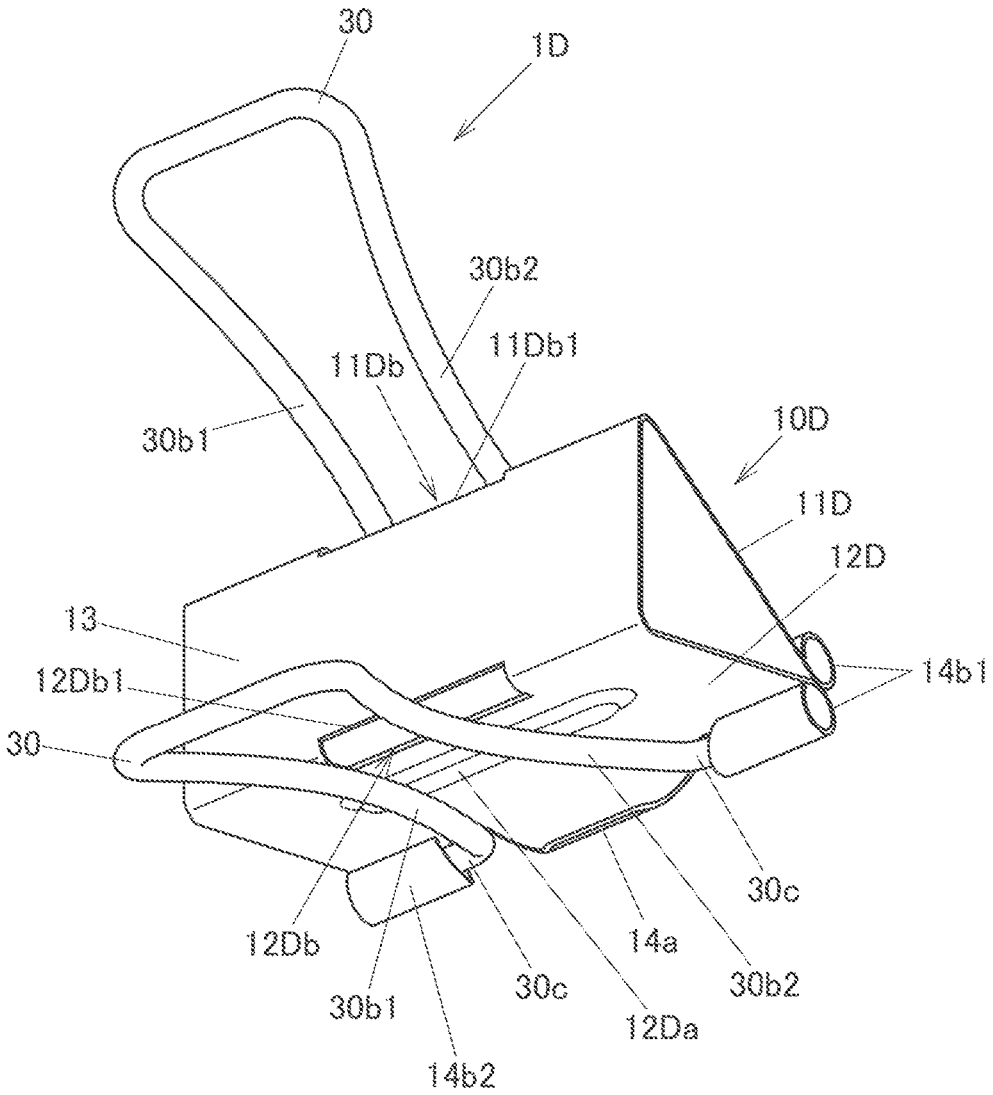
FIG. 12 is a perspective view of the double clip according to the fourth modified example made to the embodiment of the invention as seen from a bottom plate portion side thereof.
Figure 13:
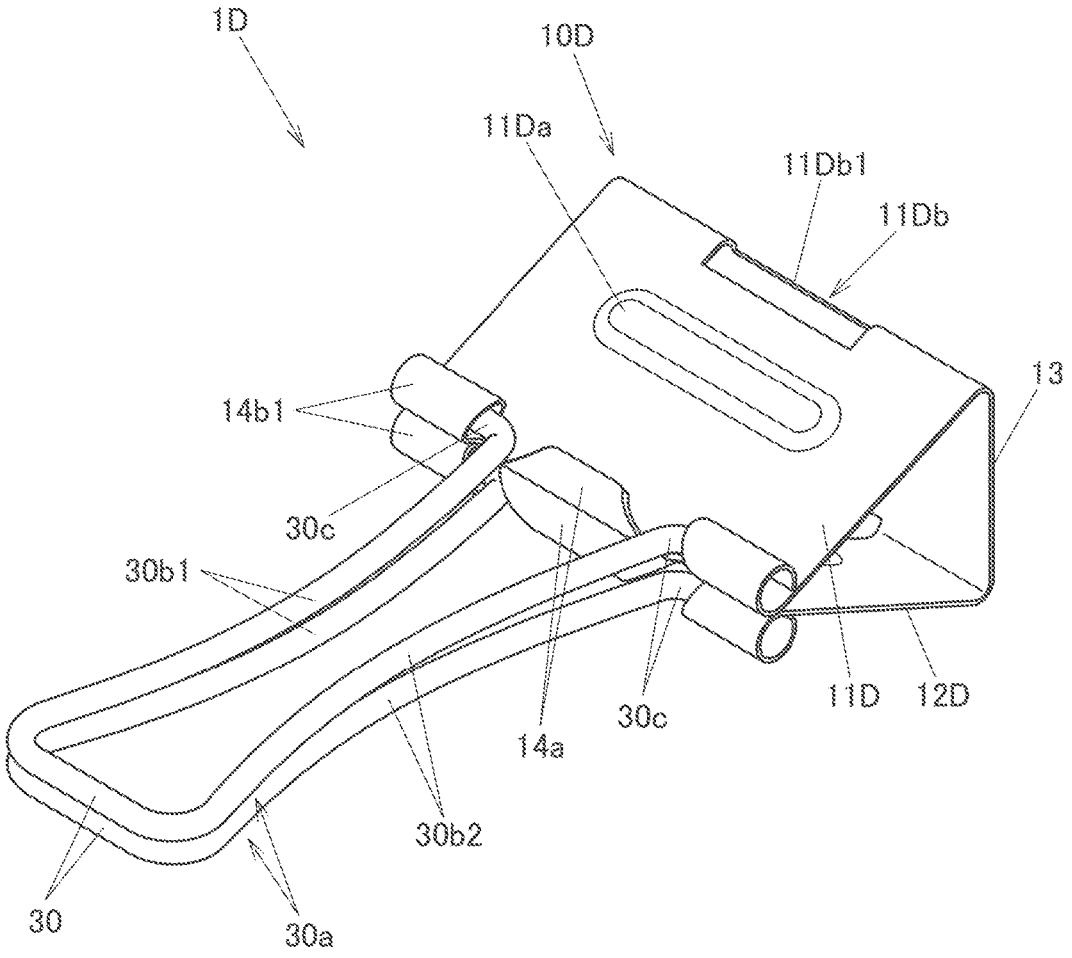
FIG. 13 is a perspective view of the double clip according to the fourth modified example made to the embodiment of the invention with a pair of lever members closed together.

Next, referring to FIGS. 11 to 14, a double clip 1D according to a fourth modified example made to the embodiment of the invention will be described. Here, like reference numerals will be given to like members and portions to those of the double clip 1 described in the embodiment described above, and a description thereof will be omitted or simplified. As shown in FIGS. 11 to 13, similar to the first fulcrum portions 11Ca, 12Ca of the double clip 1C of the third modified example described above, first fulcrum portions 11Da, 12Da are formed on plate-shaped portions 11D, 12D of the double clip 1D so as to extend a predetermined length that is shorter than a width of the plate-shaped portions 11D, 12D while protruding from outer surfaces of the plate-shaped portions 11D, 12D.

Then, recessed fulcrum portions 11Db, 12Db having a cut-out recess-like shape are formed on portions of a clip main body 10D where a single metallic plate is bent to be formed into the clip main body 10D or connecting portions where a bottom plate portion 13 connects to the plate-shaped portions 11D, 12D at locations that face linear wire portions 30*b*1, 30*b*2 of a pair of lever members 30. The recessed fulcrum portions 11Db, 12Db are formed by cutting out the connecting portions over a length that is slightly longer than a space defined between the linear wire portions 30*b*1, 30*b*2 longitudinally along a width direction of the plate-shaped portions 11D, 12D. Thus, the recessed fulcrum portions 11Db, 12Db include edge portions 11Db1, 12Db1 from which edges of the bottom plate portion 13 are exposed.

Figure 14:
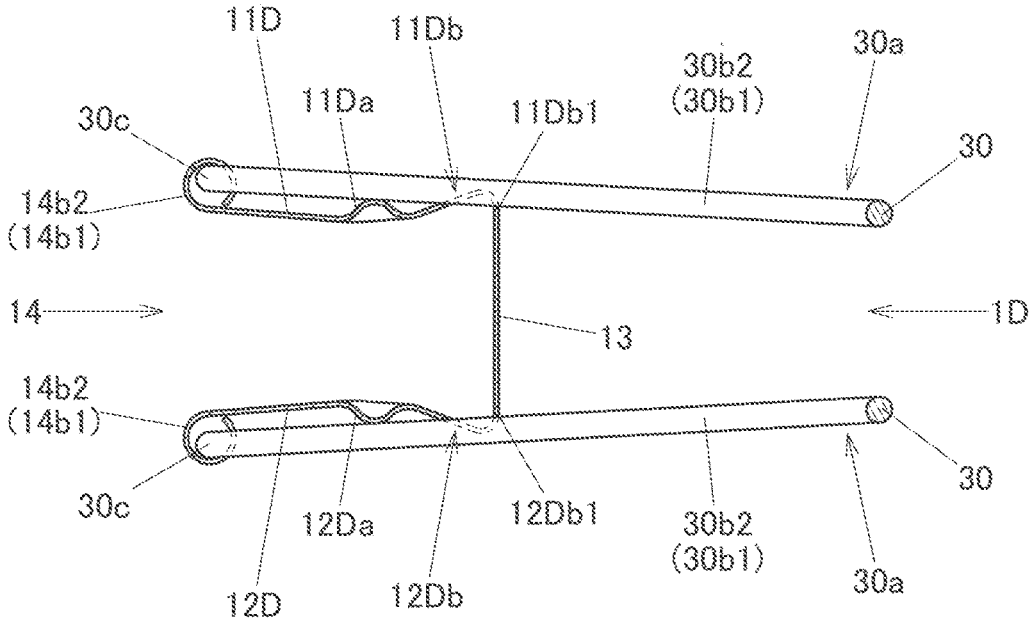
FIG. 14 is a sectional view of the double clip according to the fourth modified example made to the embodiment of the invention taken along a line A-A in FIG. 11 and showing a state in the opening operation where fulcrums are shifted.

In the double clip 1D, too, the first fulcrum portions 11Da, 12Da remain as fulcrum portions of the lever members 30 when the lever members 30 are operated to open an opening portion 14 until a predetermined open space is defined in the opening portion 14. Then, when the lever members 30 continue to be operated further to open the opening portion 14, as shown in FIG. 14, the linear wire portions 30*b*1, 30*b*2 of the lever members 30 are brought into abutment with the edge portions 11Db1, 12Db1 of the recessed fulcrum portions 11Db, 12Db, and the edge portions 11Db1, 12Db1 of the recessed fulcrum portions 11Db, 12Db function as fulcrum portions (second fulcrum portions).

Using the edge portions 11Db1, 12Db1 as the fulcrum portions (the second fulcrum portions) by forming the recessed fulcrum portions 11Db, 12Db is preferable particularly when a protruding height by which the first fulcrum portions 11Da, 12Da protrude cannot be obtained sufficiently due to working conditions or the like. Namely, unless the recessed fulcrum portions 11Db, 12Db exist in the case described above, the linear wire portions 30*b*1, 30*b*2 of the lever members 30 come into abutment with the connecting portions between the bottom plate portion 13 and the plate-shaped portions 11D, 12D before the opening portion 14 is opened to such an extent that the predetermined open space is defined therein, whereby the predetermined open space becomes narrower than required or designed. However, providing the recessed fulcrum portions 11Db, 12Db allows the lever members 30 to continue to be operated on the first fulcrum portions 11Da, 12Da as the fulcrums until the linear wire portions 30*b*1, 30*b*2 of the lever members 30 come into abutment with the edge portions 11Db1, 12Db1. This enables the opening portion 14 to be opened until the predetermined open space is defined therein.

Further, forming the recessed fulcrum portions 11Db, 12Db mitigates a holding force of the opening portion 14 by virtue of an elastic or spring-back force generated in the connecting portions between the bottom plate portion 13 and the plate-shaped portions 11D, 12D, and hence, this configuration is preferable when the holding force of the opening portion 14 is found too strong. Similar to the double clip 1 of the embodiment described above, in the double clip 1D of this fourth embodiment, as shown in FIGS. 11 and 12, the lever members 30 are disposed so that the linear wire portions 30*b*1, 30*b*2 of the lever members 30 are brought into abutment with the first fulcrum portions 11Da, 12Da. Then, as shown in FIG. 13, the pair of lever members 30 can also be closed together.

Fifth Modified Example

Figure 15:
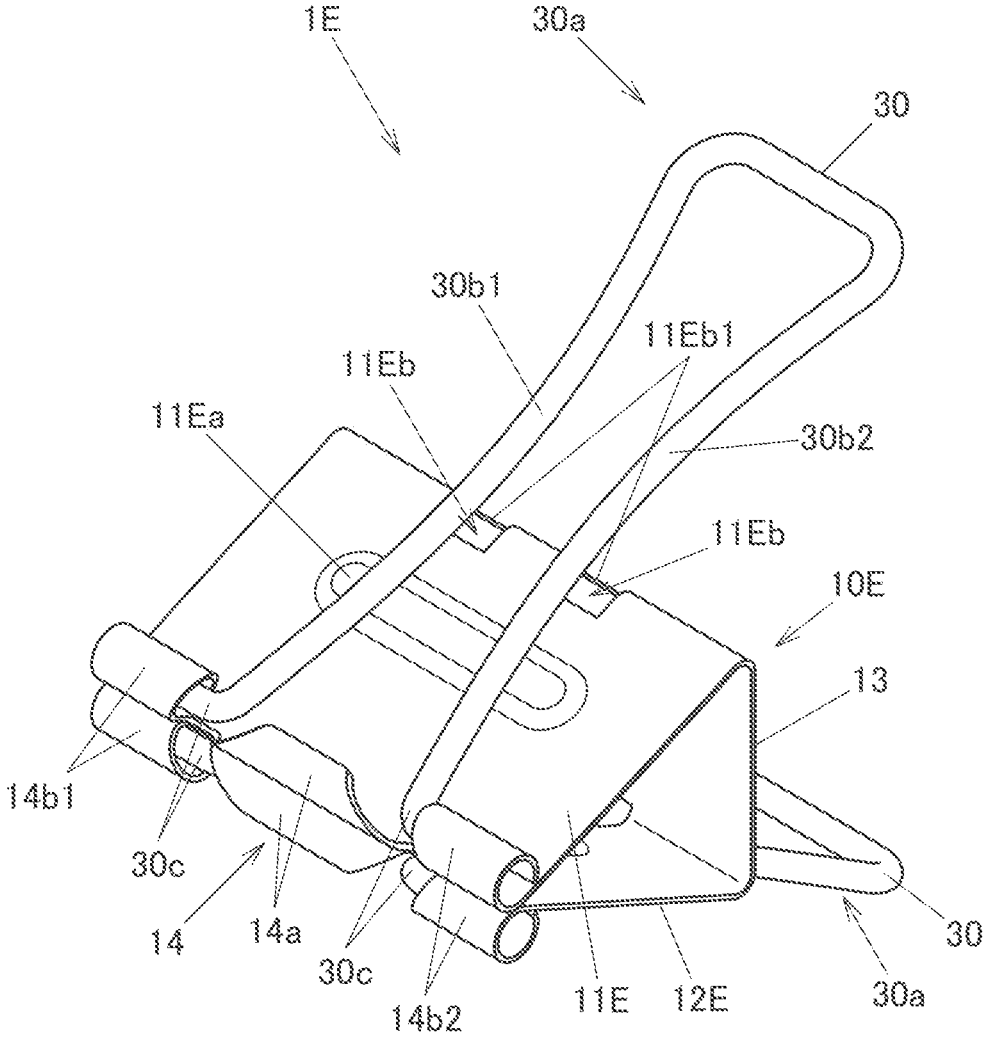
FIG. 15 is a perspective view of a double clip according to a fifth embodiment made to the embodiment of the invention as seen from an opening portion side thereof.
Figure 16:
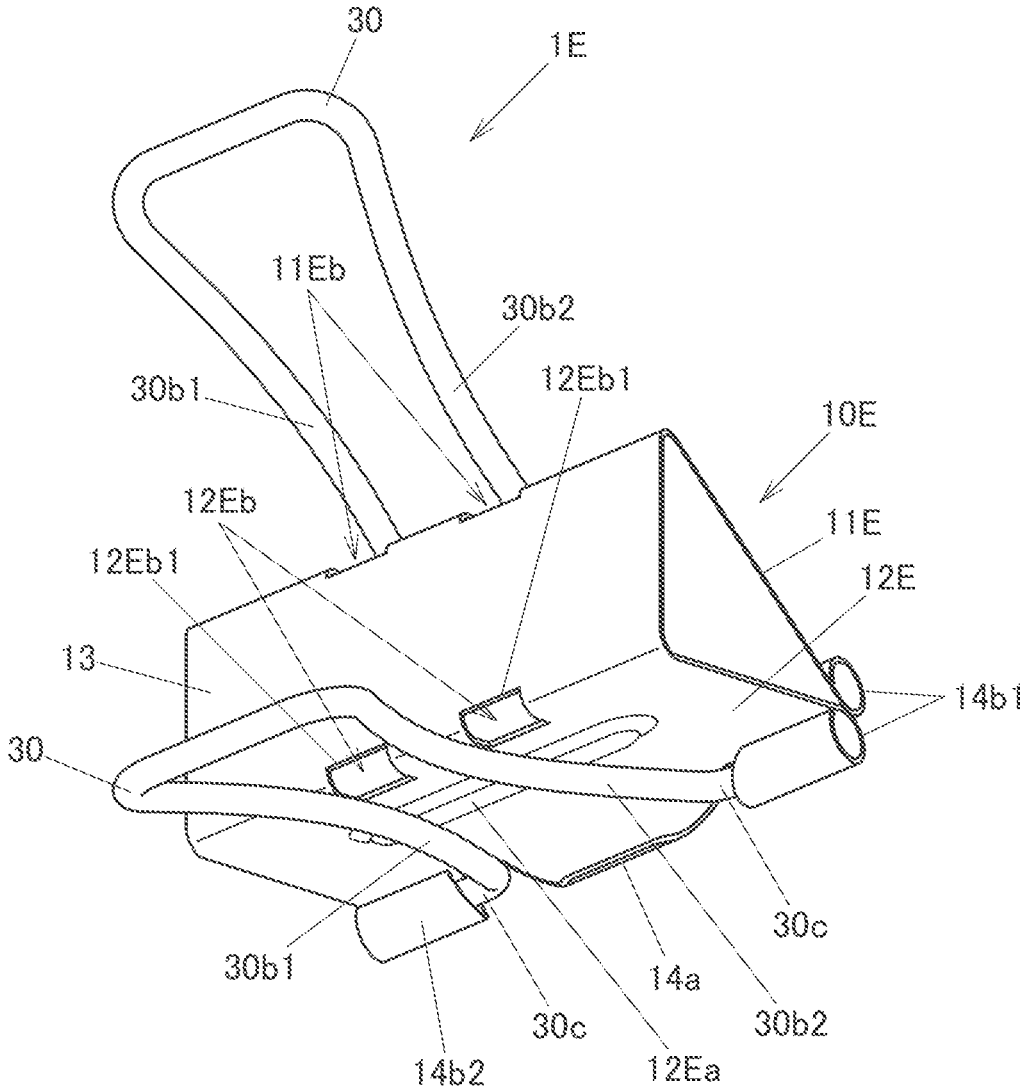
FIG. 16 is a perspective view of the double clip according to the fifth modified example made to the embodiment of the invention as seen from a bottom plate portion side thereof.
Figure 17:
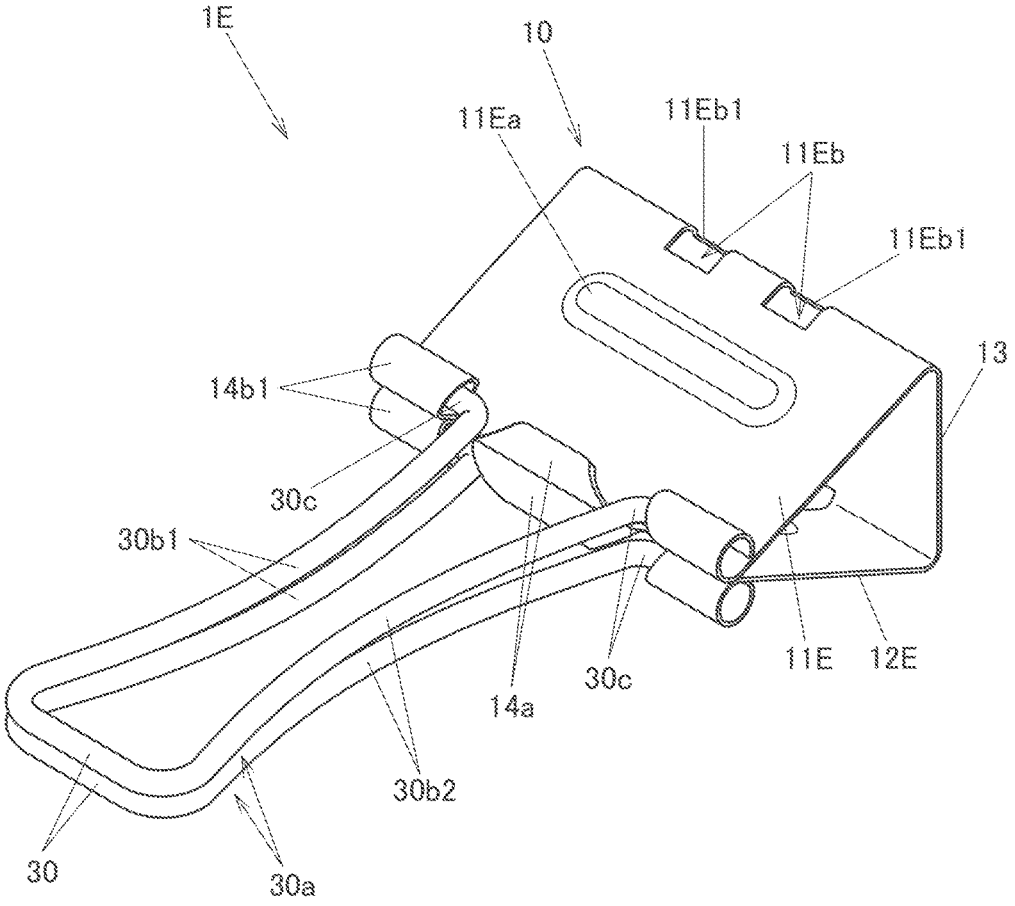
FIG. 17 is a perspective view of the double clip according to the fifth modified example made to the embodiment of the invention with a pair of lever members closed together.

Next, referring to FIGS. 15 to 17, a double clip 1E according to a fifth modified example made to the embodiment of the invention will be described. Here, like reference numerals will be given to like members and portions to those of the double clip 1 described in the embodiment described above, and a description thereof will be omitted or simplified. Similar to the first fulcrum portions 11Ca, 12Ca of the double click 10C of the third modified example, first fulcrum portions 11Ea, 12Ea are formed on first plate-shaped portions 11E, 12E of the double clip 1E so as to extend a predetermined length that is shorter than a width of the plate-shaped portions 11E, 12E while protruding from surfaces thereof.

Then, two recessed fulcrum portions 11Eb having a cut-out recess-like shape and two recessed fulcrum portions 12Eb having a cut-out recess-like shape are formed individually on portions of a clip main body 10E where a single metallic plate is bent to be formed into the clip main body 10E or connecting portions where a bottom plate portion 13 connects to the plate-shaped portions 11E, 12E at locations that face linear wire portions 30*b*1, 30*b*2 of a pair of lever members 30 for the corresponding linear wire portions 30*b*1, 30*b*2. The recessed fulcrum portions 11Eb, 12Eb are formed by cutting out the connecting portions over a length that is slightly longer than a thickness of the linear wire portions 30*b*1, 30*b*2 along a width direction of the plate-shaped portions 11E, 12E. Thus, the recessed fulcrum portions 11Eb, 12Eb include edge portions 11Eb1, 12Eb1 from which edges of the bottom plate portion 13 are exposed.

In the double clip 1E, too, similar to the double clip 1D of the fourth modified example described above, the first fulcrum portions 11Ea, 12Ea remain as fulcrum portions of the lever members 30 when the lever members 30 are operated to open an opening portion 14 until a predetermined open space is defined in the opening portion 14. Then, when the lever members 30 continue to be operated further to open the opening portion 14, the linear wire portions 30*b*1, 30*b*2 of the lever members 30 are brought into abutment with the edge portions 11Eb1, 12Eb1 of the recessed fulcrum portions 11Eb, 12Eb, and the edge portions 11Eb1, 12Eb1 of the recessed fulcrum portions 11Eb, 12Eb function as fulcrum portions (second fulcrum portions).

The recessed fulcrum portions 11Eb, 12Eb of the double clip 1E of the fifth embodiment is preferable for application to, for example, a case where the holding force of the opening portion 14 cannot be obtained sufficiently with the recessed fulcrum portions 11Db, 12Db of the double clip 1D of the fourth modified example. Namely, in the double clip 1E, a spring-back force is generated by the single metallic plate as a result of the metallic plate being bent at the connecting portions between the bottom plate portion 13 and the plate-shaped portions 11E, 12E, and end portions of the plate-shaped portions 11E, 12E are closed together at the opening portion 14 by virtue of the spring-back force so generated. However, as in the case with the fourth modified example, when the connecting portions become short as a result of the connecting portions being cut out long, the holding force of the opening portion 14 is reduced to a small level. Thus, as in the case with the fifth modified example, providing the two recessed fulcrum portions 11Eb and the two recessed fulcrum portions 12Eb individually on the connecting portions so as to correspond to the linear wire portions 30*b*1, 30*b*2 of the lever members 30 allows connecting portions to be formed between the two recessed fulcrum portions 11Eb and the two recessed fulcrum portions 12Eb, respectively. This can increase not only the holding force of the opening portion 14 but also the predetermined open space defined in the opening portion 14 when the opening portions 14 is opened. Similar to the double clip 1 of the embodiment described above, in the double clip 1E of this modified example, the lever members 30 are disposed so that the linear wire portions 30*b*1, 30*b*2 of the lever members 30 are brought into abutment with the first fulcrum portions 11Ea, 12Ea. Then, the pair of lever members 30 can also be closed together as shown in FIG. 17.

As described in the double clips 1 and 1A to 1E described in the embodiment and its modified examples, the fulcrum portions on which the lever members are operated to open the opening portion 14 can selectively take various forms as required based on conditions of equipment by and material of which the double clips are fabricated, including the form of the first fulcrum portions 11*a* (12*a*), 11Ca (12Ca), 11Da (12Da), 11Ea (12Ea), the abutment portions 31, 32 or protruding portions that are provided on the outer surfaces of the plate-shaped portions so as to protrude therefrom at the locations facing the linear wire portions 30*b*1, 30*b*2 of the lever members 30. The protruding portions functioning as the first fulcrum portions provided individually on the outer surfaces of the plate-shaped portions at the locations that face the linear wire portions 30*b*1, 30*b*2 can be formed so as to protrude from the plate-shaped portions or can be formed by attaching separate members to the relevant locations of the outer surfaces of the plate-shaped portions.

Then, the fulcrum portions (the first fulcrum portions 11*a* (12*a*), 11Ca (12Ca), 11Da (12Da), 11Ea (12Ea), and the abutment portions 31, 32) that are formed in the way described above are all disposed closer to the bottom plate portion 13 side than the central position of the distance from the bottom plate portion 13 to the opening portion 14.

Thus, while the embodiment and its modified example of the invention have been described heretofore, the invention is not limited by the embodiment and its modified examples, and hence, the invention can be carried out in various forms.

The invention claimed is:

1. A double clip having:

a clip main body having two plate-shaped portions and a bottom plate portion that connects the plate-shaped portions, wherein an opening portion is formed by the plate-shaped portions that are brought into abutment with each other by virtue of spring or elasticity of the plate-shaped portions;

a pair of lever members connected to the plate-shaped portions; and fulcrum portions that are formed individually between the plate-shaped portions and the pair of lever members and constitute fulcrums when the pair of lever members are operated to open the opening portion, wherein the fulcrum portions are each disposed closer to the bottom plate portion than the opening portion, wherein the fulcrum portions are formed so as to protrude from the plate-shaped portions, wherein the fulcrum portions are formed to extend a predetermined length that is shorter than a width of the plate-shaped portions while protruding from the plate-shaped portions, wherein the fulcrum portions are configured as first fulcrum portions, wherein second fulcrum portions are formed in positions that are located closer to the bottom plate portion than the first fulcrum portions and that face the pair of lever members, and wherein fulcrums of the pair of lever members when the pair of lever members are operated to open the opening portion stay at the first fulcrum portions until the opening portion is opened from a closed state to such an extent that a predetermined open space is defined in the opening portion, and the fulcrums of the pair of lever members shift to the second fulcrum portions when the pair of lever members continue to be operated further to open the opening portion more after the opening portion has been opened to define the predetermined open space therein.

2. The double clip according to claim 1, wherein the second fulcrum portions are formed at connecting portions where the plate-shaped portions connect to the bottom plate portion.

3. The double clip according to claim 2, wherein the second fulcrum portions comprise recessed fulcrum portions that are formed by cutting out the connecting portions.

* * * * *